US007011515B1

(12) United States Patent
Hsu

(10) Patent No.: US 7,011,515 B1
(45) Date of Patent: Mar. 14, 2006

(54) GAS LIGHTER HAVING DEVICE FOR PREVENTING FLAME FROM BEING EXTINGUISHED BY WIND

(76) Inventor: Huang-Hsi Hsu, 8F., No. 14 Lane 252, Chungshan N. Rd., Sec. 6, Taipei (TW)

( * ) Notice: Subject to any disclaimer, the term of this patent is extended or adjusted under 35 U.S.C. 154(b) by 0 days.

(21) Appl. No.: 10/965,836

(22) Filed: Oct. 18, 2004

(51) Int. Cl.
*F23Q 2/016* (2006.01)
*F23Q 3/00* (2006.01)

(52) U.S. Cl. ..... 431/126; 431/268; 431/344; 431/345; 431/347

(58) Field of Classification Search ..... 431/268, 431/347, 344, 126, 345
See application file for complete search history.

(56) References Cited

U.S. PATENT DOCUMENTS

| | | | | | |
|---|---|---|---|---|---|
| 81,734 | A * | 9/1868 | Barbarin | 431/268 |
| 808,513 | A * | 12/1905 | Cox | 431/112 |
| 1,048,016 | A * | 12/1912 | Weiderhold | 431/347 |
| 1,056,285 | A * | 3/1913 | Litle, Jr. | 431/347 |
| 2,828,814 | A * | 4/1958 | Larkin, Jr | 431/13 |
| 3,224,488 | A * | 12/1965 | Skonecke et al. | 431/265 |
| 3,238,994 | A * | 3/1966 | Kirk | 431/347 |
| 3,544,255 | A * | 12/1970 | Francis | 431/350 |
| 4,941,818 | A * | 7/1990 | Ohe et al. | 431/268 |
| 5,055,034 | A * | 10/1991 | Wang | 431/255 |
| 5,743,724 | A * | 4/1998 | Mifune et al. | 431/126 |
| 6,311,521 | B1 * | 11/2001 | Mifune et al. | 65/17.4 |

* cited by examiner

*Primary Examiner*—Carl D. Price
(74) *Attorney, Agent, or Firm*—Bacon & Thomas, PLLC

(57) ABSTRACT

The present invention is to provide a gas lighter, which comprises a nozzle provided at one end of a barrel extended forwardly from a housing, an auxiliary ceramic sleeve member provided at one end of a ceramic sleeve member in the barrel adjacent the nozzle, a metal ring provided at one end of the auxiliary ceramic sleeve member distal from the sleeve member, a radial metal filament provided in the metal ring, and a metal block provided in a center of the metal filament, wherein an ignition is adapted to generate flame at the end of the nozzle and burn the metal block to be hot enough to ignite gas fuel, and in a case of flame extinguished suddenly by wind, the metal block is adapted to ignite flame again in a very short period of time. As a result, it is possible of preventing large gas from leaking accidentally.

4 Claims, 5 Drawing Sheets

GAS LIGHTER HAVING DEVICE FOR PREVENTING FLAME FROM BEING EXTINGUISHED BY WIND

FIELD OF THE INVENTION

The present invention relates to gas lighters, more particularly to a gas lighter having a device for preventing its nozzle flame from being extinguished by strong wind in use.

BACKGROUND OF THE INVENTION

A conventional gas lighter is shown in FIGS. 1 and 2. As shown, the lighter comprises a housing 11, a barrel 12 extended forwardly from the housing 11, a gas fuel reservoir 13 provided in a rear of the housing 11, a valve 131 provided on one side of the gas fuel reservoir 13, an arc generator 14 provided on the other side of the gas fuel reservoir 13, the arc generator 14 including a first conductor 141 and a second conductor 143 extended therefrom, and a trigger partially projected from an opening 111 of the housing 11 and being disposed corresponding to both the valve 131 and the arc generator 14. In use, a pressing of the trigger 15 will activate both the valve 131 for discharging gas fuel from the gas fuel reservoir 13 and the arc generator 14 for generating arc.

Moreover, a nozzle 121 is provided at one end of the barrel 12, including nozzle cover 121A. A ceramic sleeve member 16 is provided in the barrel 12 adjacent the nozzle 121. An auxiliary ceramic sleeve member 17 is provided at one end of the sleeve member 16 distal from the housing 11. A guide sleeve 18 is provided at the other end of the sleeve member 16 proximate the housing 11. One end of the auxiliary ceramic sleeve member 17 distal from the sleeve member 16 is provided at one end of the nozzle 121 and the other end thereof is provided at a burning member 19. A gas pipe 20 and the first conductor 141 of the art generator 14 are provided on the guide sleeve 18. One end of the gas pipe 20 is coupled to the valve 131 of the gas fuel reservoir 13 and the other end thereof is coupled to the burning member 19. As such, gas fuel in the gas fuel reservoir 13 may flow to the burning member 19 via the gas pipe 20 for ignition. The first conductor 141 is coupled to the burning member 19 and the second conductor 143 of the arc generator 14 is coupled to the barrel 12.

By configuring as above, in operation a pressing of the trigger 15 will activate both the valve 131 for discharging gas fuel from the gas fuel reservoir 13. The discharged gas fuel then flows to the burning member 19. As such, arc is generated in the arc generator 14 to ignite the end of the nozzle 121. As an end, flame is generated thereat.

For maintaining flame the prior art requires the user to continuously press the trigger 15 for discharging gas fuel from the gas fuel reservoir 13 and flowing the same to the burning member 19. However, it is often that flame may be extinguished by wind, particularly in an outdoor environment. Such gas leaking from the burning member 19 can be large and may cause air pollution and even may cause danger to nearby persons because of explosion or being poisoned by carbon oxide (CO) in the gas. Hence, a need for improvement exists.

SUMMARY OF THE INVENTION

After considerable research and experimentation, a gas lighter having a device for preventing flame from being extinguished by strong wind and thus preventing gas fuel from leaking in use according to the present invention has been devised.

It is an object of the present invention to provide a gas lighter having device for preventing flame from being extinguished by wind so that even flame is extinguished it is possible of igniting flame again in a very short period of time.

To achieve the above and other objects, the gas lighter of the present invention comprises a housing, a barrel extended forwardly from the housing, a nozzle provided at one end of the barrel, a ceramic sleeve member provided in the barrel adjacent the nozzle, an auxiliary ceramic sleeve member provided at one end of the sleeve member distal from the housing, a guide sleeve provided at the other end of the sleeve member wherein one end of the auxiliary ceramic sleeve member distal from the sleeve member is provided at one end of the nozzle and the other end thereof is provided at a burning member, and a gas pipe and a conductor provided on the guide sleeve wherein one end of the gas pipe is coupled to a gas fuel reservoir in the housing and the other end thereof is coupled to the burning member such that gas fuel in the gas fuel reservoir may flow to the burning member via the gas pipe for ignition and the conductor is electrically connected to the burning member.

The gas lighter of the present invention further comprises a metal ring provided at one end of the auxiliary ceramic sleeve member distal from the sleeve member, a radial metal filament provided in the metal ring, and a metal block provided in a center of the metal filament wherein the ignition is adapted to generate flame at the end of the nozzle and burn the metal block to be hot enough to ignite gas fuel, and in a case of flame extinguished suddenly by wind, the metal block is adapted to ignite flame again in a very short period of time (e.g., within one second). As a result, it is possible of preventing large gas from leaking accidentally.

It is another object of the present invention to provide an elongated opening on a surface of the housing corresponding to the gas fuel reservoir such that a user is able to know the amount of remaining gas fuel in the gas fuel reservoir by viewing through the opening.

The above and other objects, features and advantages of the present invention will become apparent from the following detailed description taken with the accompanying drawings.

DETAILED DESCRIPTION OF THE PREFERRED EMBODIMENTS

Figure 1:
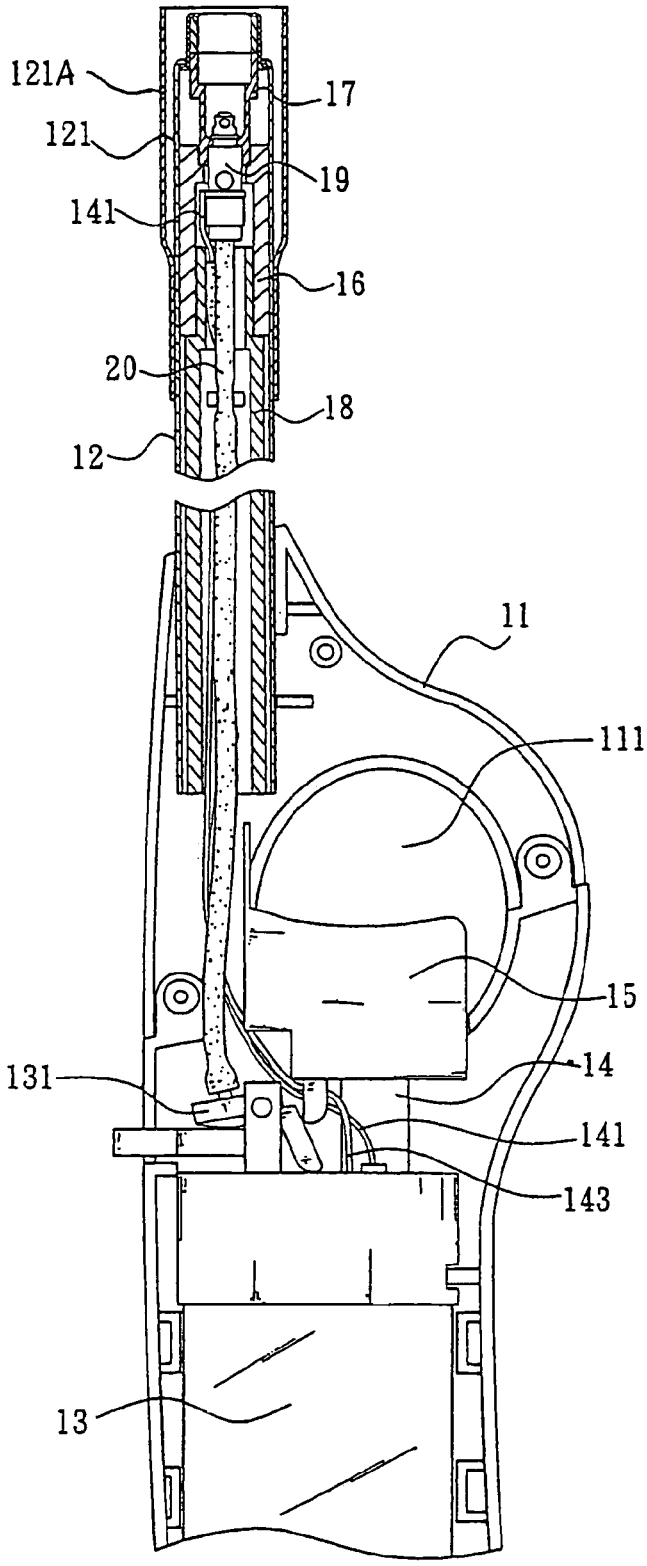
FIG. 1 (Prior Art)
FIG. 1 is a perspective view in part section of interior of a conventional gas lighter.
Figure 2:
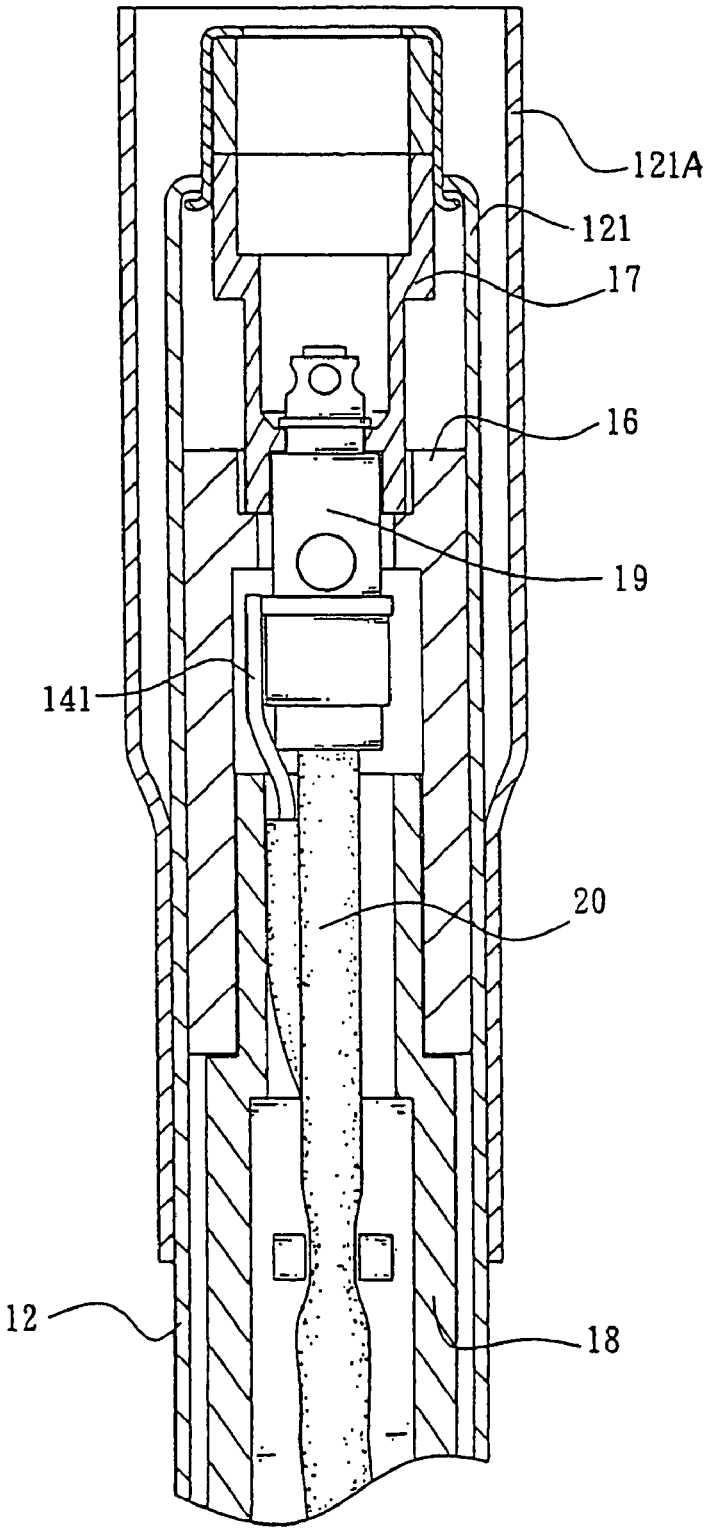
FIG. 2 (Prior Art)
FIG. 2 is a greatly enlarged view of the head of barrel shown in FIG. 1.
Figure 3:
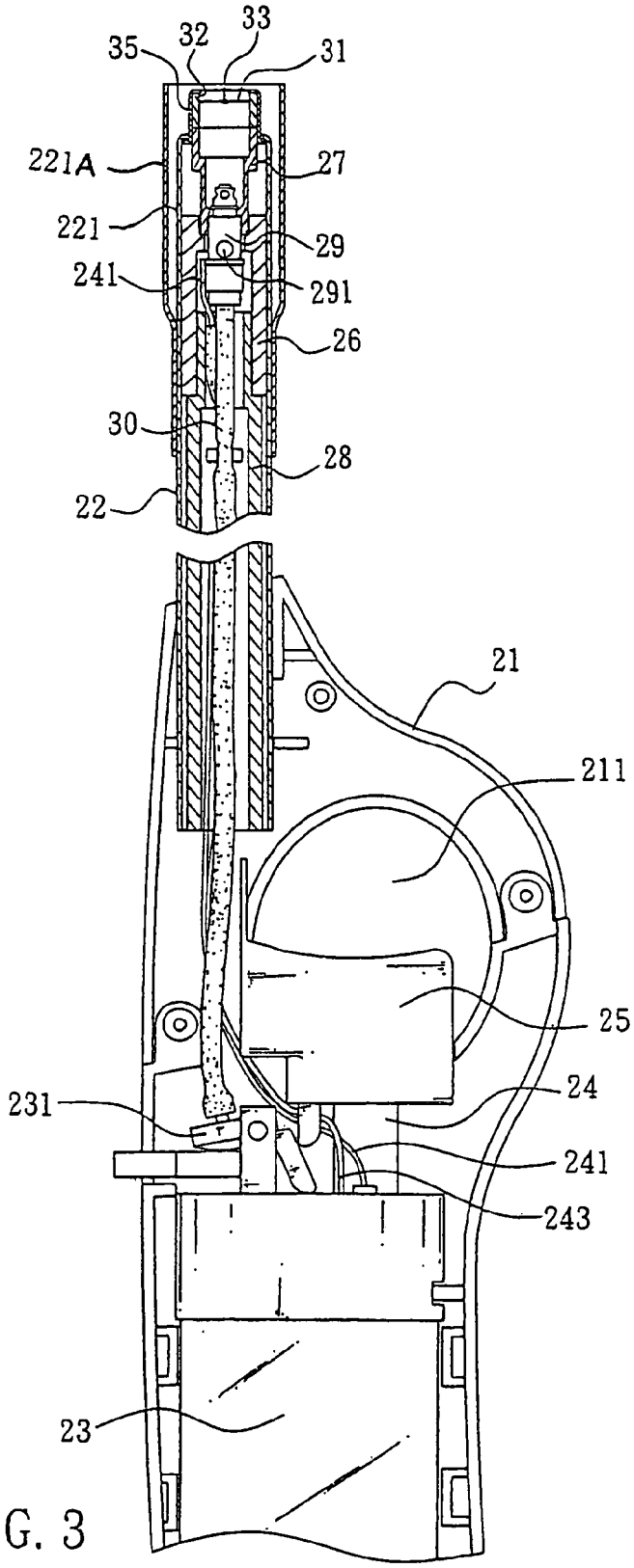
FIG. 3 is a perspective view in part section of interior of a gas lighter according to the invention.
Figure 4:
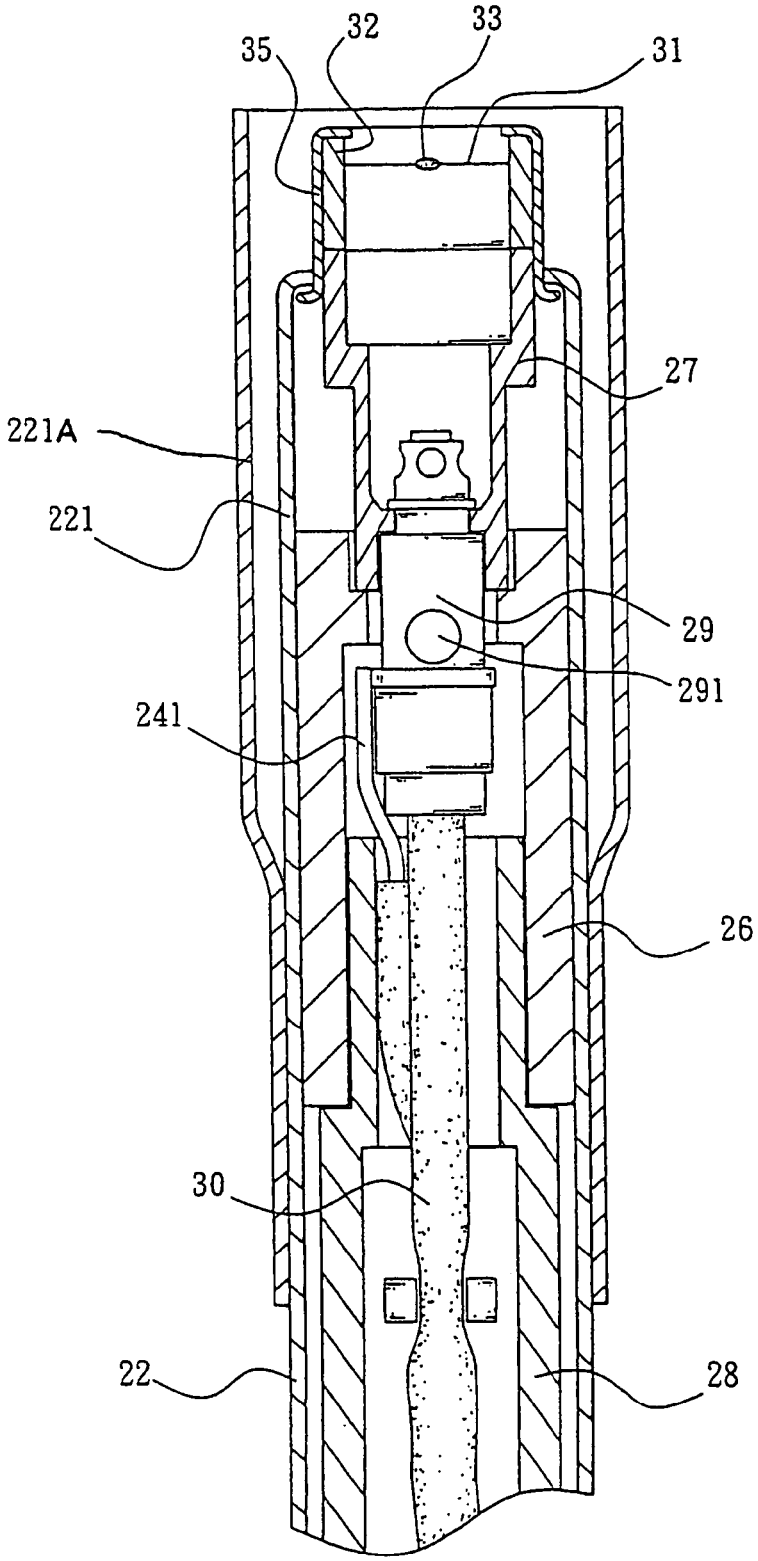
FIG. 4 is a greatly enlarged view of the head of barrel shown in FIG. 3.

Referring to FIGS. 3 and 4, there is shown a gas lighter having a device for preventing flame from being extinguished by wind in accordance with the invention. As shown, the lighter comprises a housing 21, a barrel 22 extended forwardly from the housing 21, a gas fuel reservoir 23 provided in a rear of the housing 21, a valve 231 provided on one side of the gas fuel reservoir 23, an arc generator 24 provided on the other side of the gas fuel reservoir 23, the arc generator 24 including a first conductor 241 and a second conductor 243 extended therefrom, and a trigger 25 partially projected from an opening 211 of the housing 21 and being disposed corresponding to both the valve 231 and the arc generator 24. In use, a pressing of the trigger 25 will activate both the valve 231 for discharging gas fuel from the gas fuel reservoir 23 and the arc generator 24 for generating arc.

Moreover, a nozzle 221 is provided at one end of the barrel 22, including a nozzle cover 221A. A ceramic sleeve member 26 is provided in the barrel 22 adjacent the nozzle 221. An auxiliary ceramic sleeve member 27 is provided at a first end of the sleeve member 26 distal from the housing 21. A guide sleeve 28 is provided at a second end of the sleeve member 26. A first end of the auxiliary ceramic sleeve member 27 distal from the sleeve member 26 is provided at a forward end of the nozzle 221 and a second end of the auxiliary ceramic sleeve member 27 is provided with a burning member 29. A gas pipe 30 and the first conductor 241 of the arc generator 24 are provided on the guide sleeve 28. A first end of the gas pipe 30 is coupled to the valve 231 of the gas fuel reservoir 23 and a second end thereof is coupled to the burning member 29. As such, gas fuel in the gas fuel reservoir 23 may flow to the burning member 29 via the gas pipe 30 for ignition. The first conductor 241 is electrically connected to the burning member 29 and the second conductor 243 of the arc generator 24 is electrically connected to the barrel 22. Moreover, a metal ring 32 is provided at one end of the auxiliary ceramic sleeve member 27 distal from the sleeve member 26. A radial metal filament 31 (e.g., tungsten filament) is provided in the metal ring 32. A metal block 33 (e.g., tungsten block) is provided in a center of the metal filament 31.

By configuring as above, as shown in FIGS. 3 and 4 again, in operation a pressing of the trigger 25 will activate both the valve 231 for discharging gas fuel from the gas fuel reservoir 23. The gas fuel then flows to the burning member 29. As such, arc is generated in the arc generator 24 to ignite the end of the nozzle 221. As an end, flame is generated thereat.

The metal block 33 is very hot as seen from its bright color when it is burned by flame generated at the end of the nozzle 221 due to the ignition. The hot metal block 33 is sufficient to ignite gas fuel. In a case of flame extinguished suddenly by strong wind, the hot metal block 33 is able to ignite flame again in a very short period of time (e.g., within one second). As such, it is possible of preventing large gas from leaking accidentally.

Referring to FIG. 3 again, an elongated opening (not shown) is provided on a surface of the housing 21 and is located corresponding to the gas fuel reservoir 23. This enables a user to know the amount of remaining gas fuel in the gas fuel reservoir 23 by viewing through the opening.

Figure 5:
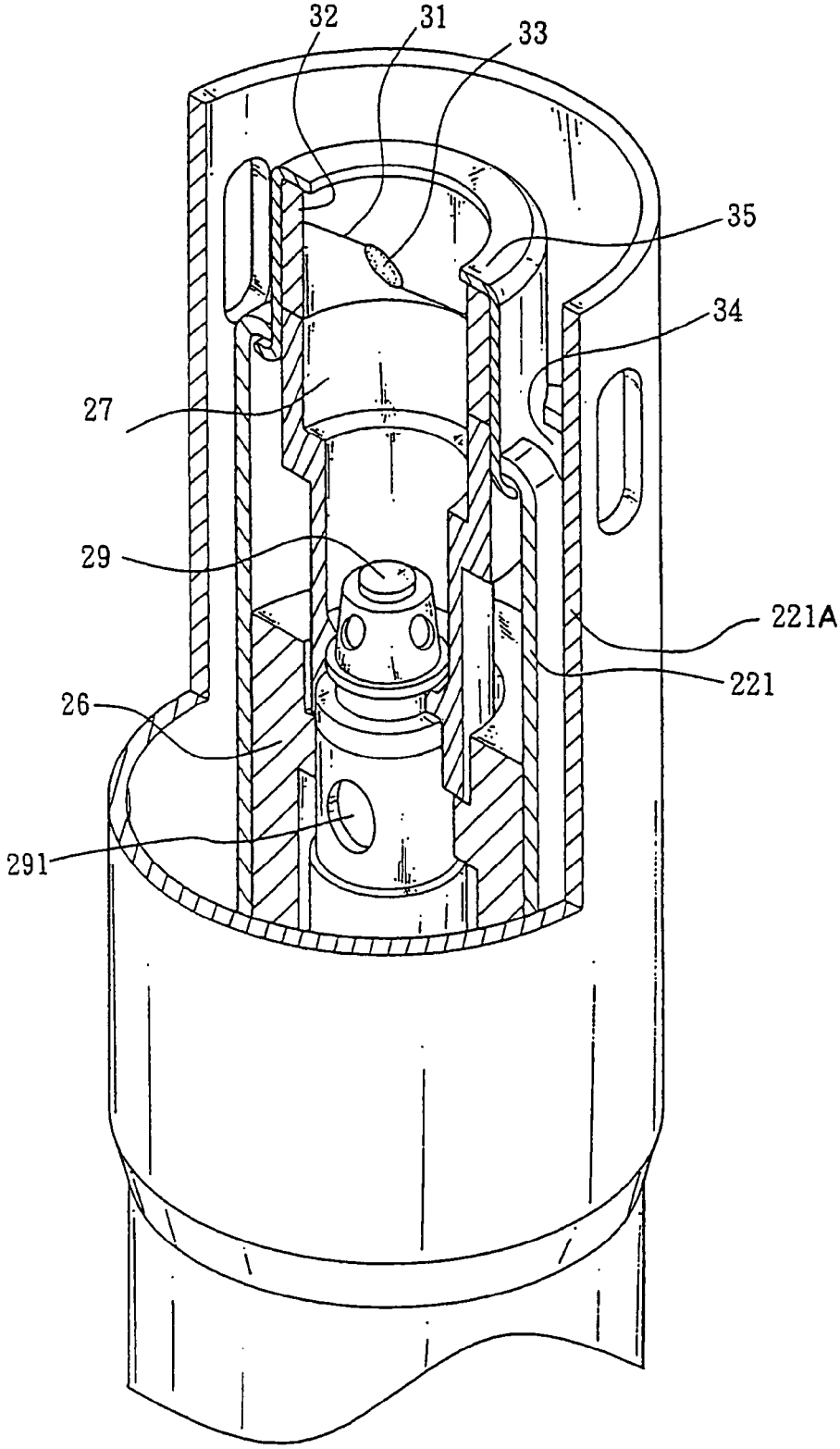
FIG. 5 is a broken-away perspective view showing interior details of the head of barrel.

Referring to FIG. 5 in conjunction with FIG. 4, a metal sleeve 35 is put on the metal ring 32. A forward end of the auxiliary ceramic sleeve member 27 is provided in a lower part of the metal sleeve 35. A plurality of equally spaced apart longitudinal channels 34 are provided in and around the concentric, cylindrical nozzle 221 such that flexibility is provided at a forward end of the nozzle 221. Also, an inner diameter of the forward end of the nozzle 221 is slightly smaller than an outer diameter of a bottom flange of the metal sleeve 35. As such, the forward end of the nozzle 221 will be slightly enlarged by the metal sleeve 35 when the metal sleeve 35 is installed therein. Hence, the forward end of the nozzle 221 is adapted to clamp the metal sleeve 35 for fastening both the metal ring 32 and the forward end of the auxiliary ceramic sleeve member 27 by its flexibility.

Referring to FIGS. 3 and 4 again, an air inlet 291 is provided on a side surface of the burning member 29. As such, air can be sucked into the burning member 29 through the air inlet for help burning.

In view of the above, even flame is extinguished suddenly by strong wind, particularly in an outdoor environment, the hot metal block 33 is still able to ignite flame again in a very short period of time (e.g., within one second). As such, the gas lighter of the invention is able to provide a safe device for preventing large gas from leaking accidentally in use.

While the invention herein disclosed has been described by means of specific embodiments, numerous modifications and variations could be made thereto by those skilled in the art without departing from the scope and spirit of the invention set forth in the claims.

What is claimed is:

1. A gas lighter with a device for preventing flame from being extinguished by wind, the gas lighter comprising:

a housing including a gas fuel reservoir disposed in a rear part thereof, a valve disposed on one side of the gas fuel reservoir, and an arc generator disposed on another side of the gas fuel reservoir, the arc generator including a first conductor and a second conductor extended therefrom;

a trigger partially projected from an opening of the housing, the trigger being configured and arranged to activate both the valve for discharging gas fuel from the gas fuel reservoir and the arc generator for generating an arc;

a barrel extending forwardly from the housing and including a nozzle disposed at one end of the barrel, a ceramic sleeve member disposed in the barrel adjacent the nozzle, an auxiliary ceramic sleeve member disposed at a first end of the sleeve member distal from the housing, the auxiliary ceramic sleeve member having a first end distal from the sleeve member disposed at a forward end of the nozzle, a guide sleeve disposed at a second end of the sleeve member, a burning member disposed at a second end of the auxiliary ceramic sleeve, and a gas pipe disposed on the guide sleeve wherein the first conductor of the arc generator is disposed on the guide sleeve, a first end of the gas pipe is coupled to the valve of the gas fuel reservoir and a second end of the gas pipe is coupled to the burning member such that gas fuel in the gas fuel reservoir is adapted to flow to the burning member via the gas pipe for ignition, the first conductor being electrically connected to the burning member, and the second conductor of the arc generator being electrically connected to the barrel; and a safety assembly including a metal ring disposed at one end of the auxiliary ceramic sleeve member distal from the sleeve member, a radial metal filament disposed in the metal ring, and a metal block disposed in a center of the metal filament;

wherein the safety assembly has a metal sleeve disposed on the metal ring, the metal sleeve having a lower part with a forward end of the auxiliary ceramic sleeve member received therein, and a plurality of equally spaced apart longitudinal channels disposed in and around the concentric, cylindrical nozzle so as to provide a flexibility at a forward end of the nozzle, wherein an inner diameter of the forward end of the nozzle is slightly smaller than an outer diameter of a bottom flange of the metal sleeve such that the forward end of the nozzle will be enlarged by the metal sleeve when the metal sleeve is installed therein for causing the forward end of the nozzle to clamp the metal sleeve for fastening both the metal ring and the forward end of the auxiliary ceramic sleeve member by the flexibility;

wherein the arc generator is adapted to ignite flame at the forward end of the nozzle and heat the metal block to be hot enough to ignite gas fuel, and in a case of flame extinguished suddenly by wind, the metal block is adapted to ignite a flame again within one second.

2. The gas lighter of claim 1, further comprising an air inlet disposed on a side surface of the burning member for sucking air into the burning member therethrough for help in burning.

3. The gas lighter of claim 1, wherein the metal filament is a tungsten filament.

4. The gas lighter of claim 1, wherein the metal block is a tungsten block.

* * * * *